US011549294B1

(12) United States Patent
Peterson

(10) Patent No.: US 11,549,294 B1
(45) Date of Patent: Jan. 10, 2023

(54) OVERHEAD DOOR SYSTEM WITH CONCEALED HYDRAULIC CYLINDER

(71) Applicant: PowerLift Door Consultants, Inc., Lake Benton, MN (US)

(72) Inventor: Richard Ernest Peterson, Lake Benton, MN (US)

(73) Assignee: PowerLift Door Consultants, Inc., Lake Benton, MN (US)

( * ) Notice: Subject to any disclaimer, the term of this patent is extended or adjusted under 35 U.S.C. 154(b) by 210 days.

(21) Appl. No.: 17/030,903

(22) Filed: Sep. 24, 2020

Related U.S. Application Data

(60) Provisional application No. 63/053,300, filed on Jul. 17, 2020, provisional application No. 62/987,823, filed on Mar. 10, 2020.

(51) Int. Cl.
*E05F 11/00* (2006.01)
*E05D 15/44* (2006.01)
*E05F 15/53* (2015.01)

(52) U.S. Cl.
CPC ..... *E05D 15/445* (2013.01); *E05F 15/53* (2015.01); *E05Y 2900/108* (2013.01)

(58) Field of Classification Search
CPC ..... E05D 15/445; E05Y 2900/108
USPC ..... 49/202, 203, 206
See application file for complete search history.

(56) References Cited

U.S. PATENT DOCUMENTS

| | | | | |
|---|---|---|---|---|
| 2,472,602 | A * | 6/1949 | Manville | E05D 15/583 49/206 |
| 3,464,161 | A * | 9/1969 | Karlo | E05D 15/403 49/203 |
| 3,468,060 | A * | 9/1969 | Mursinna | E05F 15/59 49/203 |
| 6,883,273 | B2 * | 4/2005 | Kerkvliet | E05F 15/53 49/203 |
| 8,327,586 | B2 * | 12/2012 | Keller | E05F 15/53 49/506 |
| 9,273,507 | B2 * | 3/2016 | Petrat | E05F 15/53 |
| 9,567,789 | B2 * | 2/2017 | Crown | E05D 15/38 |
| 9,677,314 | B2 * | 6/2017 | Houser | E05F 15/59 |
| 10,208,529 | B2 * | 2/2019 | Betker | E05D 11/06 |
| 10,604,991 | B2 * | 3/2020 | Schweiss | E05D 5/12 |
| 10,934,751 | B2 * | 3/2021 | Schweiss | E05D 3/02 |
| 11,136,815 | B2 * | 10/2021 | Schweiss | E06B 3/38 |
| 11,428,036 | B1 * | 8/2022 | Peterson | E06B 1/522 |
| 2015/0204131 | A1 * | 7/2015 | Petrat | E06B 3/5018 49/338 |

(Continued)

FOREIGN PATENT DOCUMENTS

WO WO-2022015391 A1 * 1/2022

*Primary Examiner* — Jerry E Redman
(74) *Attorney, Agent, or Firm* — Michael A. Bondi; Moss & Barnett

(57) ABSTRACT

An overhead door system including a frame, a door leaf and a first hydraulic cylinder. The door leaf is pivotally mounted to the frame. The first hydraulic cylinder has a first cylinder end and a second cylinder end. The first cylinder end is operably attached to the frame. The second cylinder end is operably attached to the door leaf. The first hydraulic cylinder is capable of moving the door leaf between a closed configuration and an open configuration. At least one of the frame and the upper door panel has a slot formed therein. When the door leaf is in the closed configuration, the first hydraulic cylinder is substantially recessed in the slot.

7 Claims, 4 Drawing Sheets

(56) References Cited

U.S. PATENT DOCUMENTS

| | | | | |
|---|---|---|---|---|
| 2015/0292250 | A1* | 10/2015 | Betker | E06B 1/522 49/197 |
| 2016/0362929 | A1* | 12/2016 | Schweiss | E05F 15/622 |
| 2017/0074019 | A1* | 3/2017 | Schweiss | E05C 1/06 |
| 2020/0224474 | A1* | 7/2020 | Schweiss | E05B 65/0085 |

* cited by examiner

OVERHEAD DOOR SYSTEM WITH CONCEALED HYDRAULIC CYLINDER

REFERENCE TO RELATED APPLICATION

This application claims priority to U.S. Pat. No. 62/987,823, which was filed on Mar. 10, 2020. The contents of which are incorporated herein by reference.

FIELD OF THE INVENTION

The invention relates generally to overhead doors. More particularly, the invention relates to overhead doors with concealed hydraulic cylinder.

BACKGROUND OF THE INVENTION

Overhead doors are commonly used to provide relatively large openings such as in machine sheds, barns and airplane hangars. The overhead doors typically utilize a hydraulic cylinder or electric actuators to assist with moving the door leaf between open and closed configurations. An example of one such overhead door system is described in U.S. Patent Publication No. 2011/0225895, which is assigned to the assignee of this application.

SUMMARY OF THE INVENTION

An embodiment of the invention is directed to an overhead door system that includes a frame, a door leaf and a first hydraulic cylinder. The door leaf is pivotally mounted to the frame. The first hydraulic cylinder has a first cylinder end and a second cylinder end. The first cylinder end is operably attached to the frame. The second cylinder end is operably attached to the door leaf. The first hydraulic cylinder is capable of moving the door leaf between a closed configuration and an open configuration. At least one of the frame and the upper door panel has a slot formed therein. When the door leaf is in the closed configuration, the first hydraulic cylinder is substantially recessed in the slot.

Another embodiment of the invention is directed to an overhead door system that includes a door leaf and a first hydraulic cylinder. The door leaf is pivotally mounted to the frame. The door leaf has at least slot formed therein. The first hydraulic cylinder has a first cylinder end and a second cylinder end. The second cylinder end is operably attached to the door leaf. The first hydraulic cylinder is capable of moving the door leaf between a closed configuration and an open configuration. When the door leaf is in the closed configuration, the first hydraulic cylinder is substantially recessed in the at least one slot.

Another embodiment of the invention is directed to a method of operating an overhead door system. A door leaf is pivotally mounted with respect to a frame. The door leaf is operably attached to the frame with a first hydraulic cylinder. The door leaf is moved between a closed configuration and an open configuration using a first hydraulic cylinder that is attached to the door leaf and the frame. The first hydraulic cylinder is substantially recessed in the slot when the door leaf is in the closed configuration.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

An embodiment of the invention is directed to an overhead door system 30 that is used to selectively close an opening in a structure such as a machine shed, barn, airplane hangar or other structure. The overhead door system 30 is particularly suited for use with a relatively wide door leaf such as having a width of more than about 20 feet.

Figure 1:
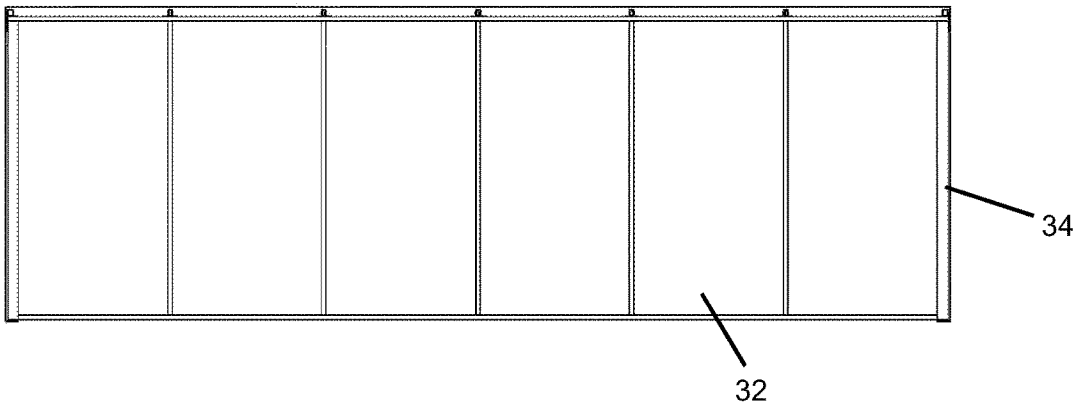
FIG. 1 is an elevation view of an overhead door system with concealed hydraulic cylinder where a door leaf is in a closed configuration.
Figure 2:
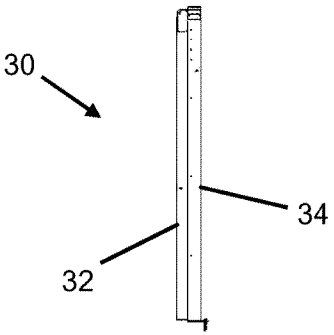
FIG. 2 is a side view of the overhead door system with the door leaf in the closed configuration.
Figure 3:
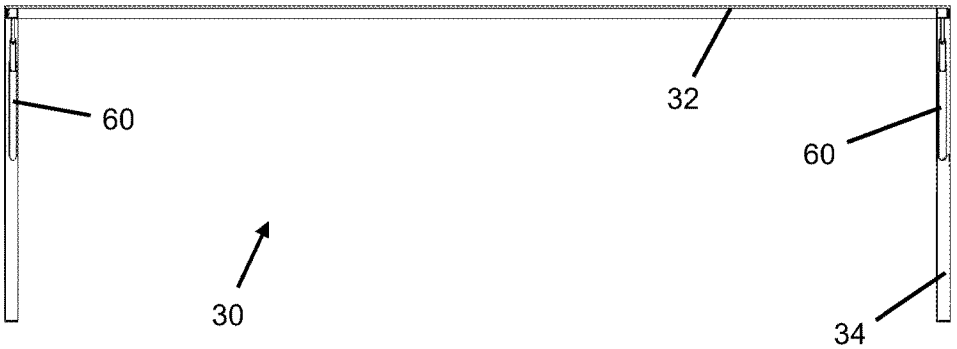
FIG. 3 is an elevation view of the overhead door system with the door leaf in an open configuration.
Figure 4:
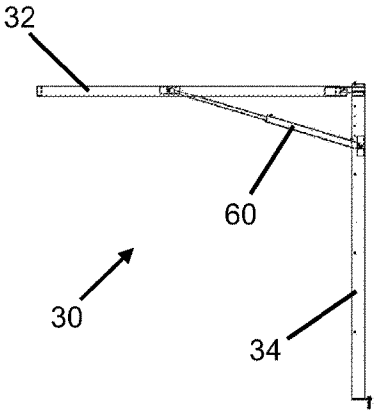
FIG. 4 is a side view of the overhead door system with the door leaf in the open configuration.

The overhead door system 30 generally include a door leaf 32 that is operably mounted with respect to a door frame 34 for movement between a closed configuration, which is illustrated in FIGS. 1 and 2, and an open configuration, which is illustrated in FIGS. 3 and 4. In certain embodiments, the door leaf 32 is vertically pivotable between the closed configuration and the open configuration.

Figure 8:
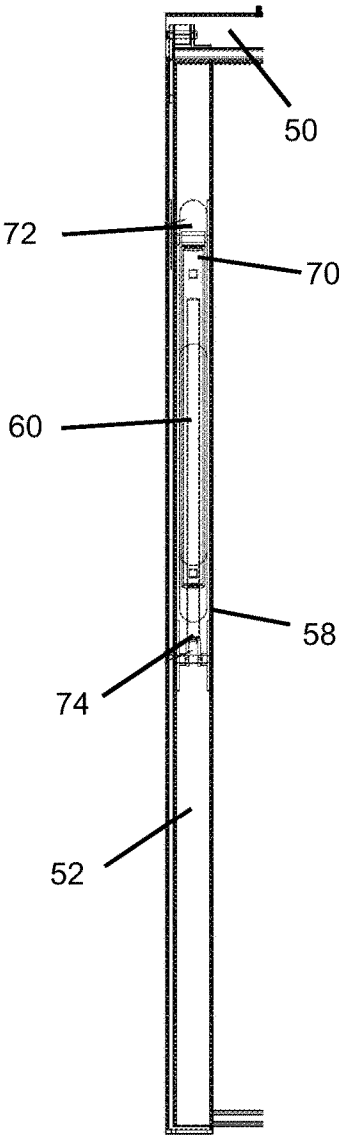
FIG. 8 is a front view illustrating attachment of the hydraulic cylinder to the door leaf and the door frame.
Figure 7:
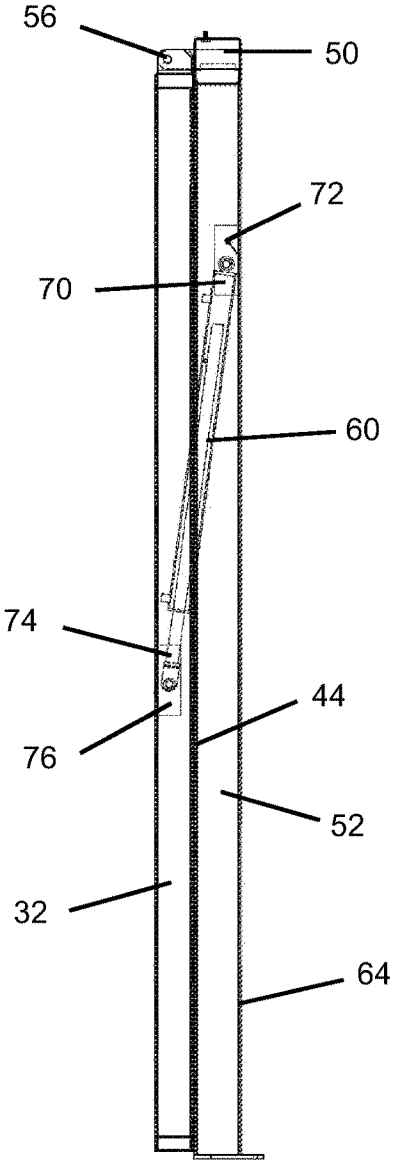
FIG. 7 is a side view illustrating attachment of a hydraulic cylinder to the door leaf and the door frame.

The hydraulic cylinder 60 is concealed when the door leaf 32 is in the closed configuration. As used herein, concealed means that no portion of the hydraulic cylinder 60 extends past a side of the door leaf 32 that is opposite the door frame 34 as illustrated in FIG. 7 and no portion of the hydraulic cylinder extends outside of the door frame 34 when the door leaf 32 is in the closed configuration as illustrated in FIG. 8.

Substantially concealing the hydraulic cylinder 60 when the door leaf 32 is in the closed configuration not only enhances the aesthetics of the overhead door system 30 but also protects the hydraulic cylinder 60 from damage.

Figure 5:
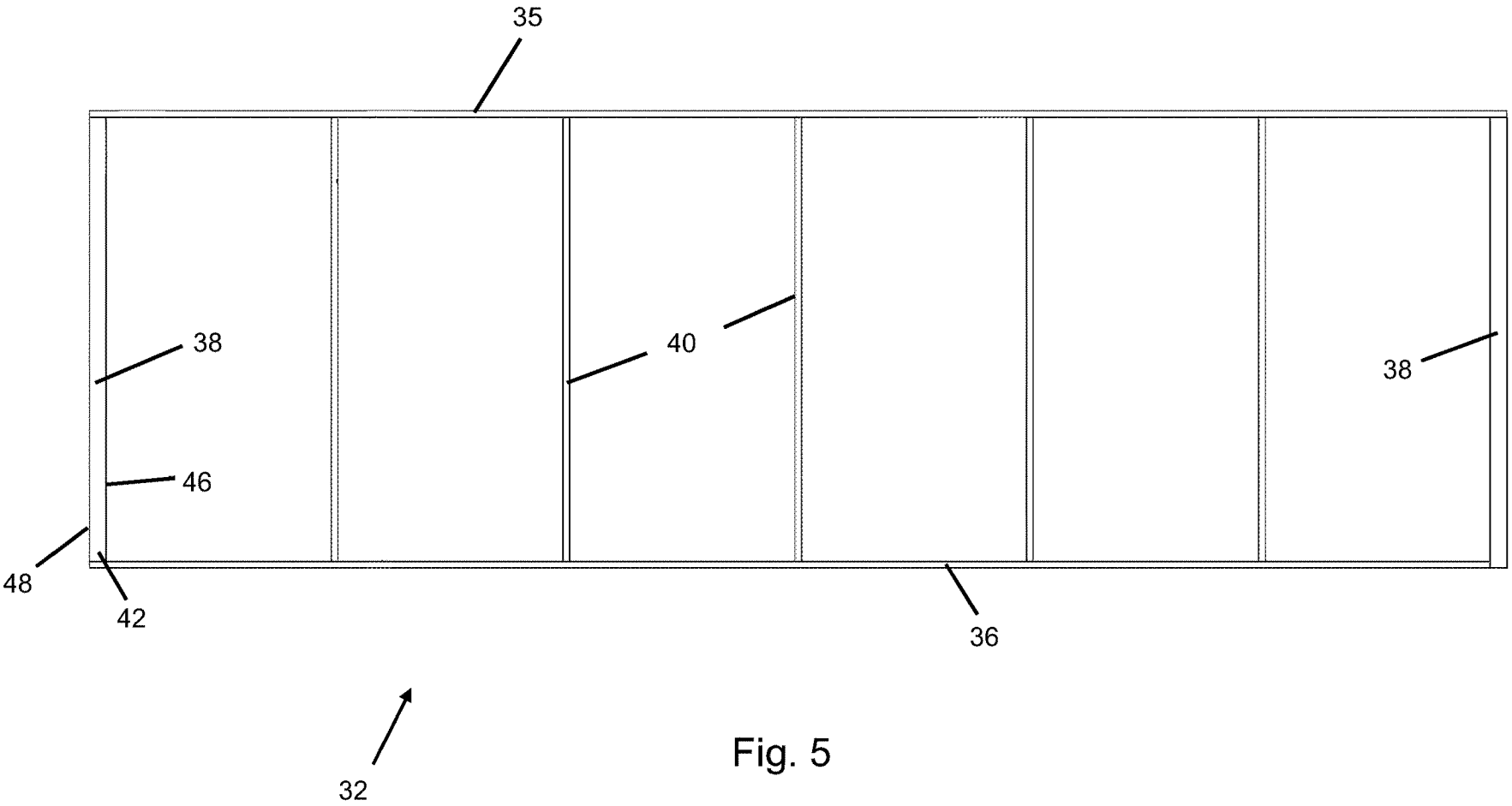
FIG. 5 is an elevation view of the door leaf.

In certain embodiments, the door leaf 32 has a generally elongated configuration that is moved as a unitary structure as illustrated in FIG. 5. A person of skill in the art will appreciate that the door leaf 32 may be adapted for use with a variety of widths and heights using the concepts of the invention depending upon the structure in which the overhead door system 30 is installed.

While it is illustrated that the door leaf 32 is a single panel, it is possible for the door leaf 32 to be fabricated in multiple sections that are attached together when the overhead door system 30 is installed. Forming the door leaf 32 in a multiple sections reduces the size for shipping the overhead door system to the installation location.

The door leaf 32 is generally defined by a top frame member 35, a bottom frame member 36 and side members 38. Depending on the width of the door leaf 32, there may also be at least one intermediate leg 40 to enhance structural rigidity of the door leaf 32.

In certain embodiments, the top frame member 35 and the bottom frame member 36 both extend between the side members 38. The top frame member 35 and the bottom frame member 36 may be oriented generally perpendicular to the side members 38.

In certain embodiments, the side members 38 may have a generally square profile that includes a first side 42, a second side 44, a third side 46 and a fourth side 48. The first side 42 is oriented towards the door frame 34. The second side 44, which is opposite the first side 42, is oriented away from the door frame 34.

The third side 46 extends between the first side 42 and the second side 44. The fourth side 48, which is opposite the third side 46, extends between the first side 42 and the second side 44. An opening is defined inside of the first side 42, the second side 44, the third side 46 and the fourth side 48.

The first side 42 may have a slot formed therein that is adapted to receive a portion of the at least one hydraulic cylinder 60. The slot extends through the first side 43 into the opening. The slot may have a generally elongated shape that is vertically oriented. The slot has a width that is greater than a width of the at least one hydraulic cylinder 60.

A person of skill in the art will appreciate that it is possible for the side members 38 to have an alternative configuration with less than four sides. For example, in an alternative configuration, the side members 38 may have only two sides using the concepts of the invention.

Figure 6:
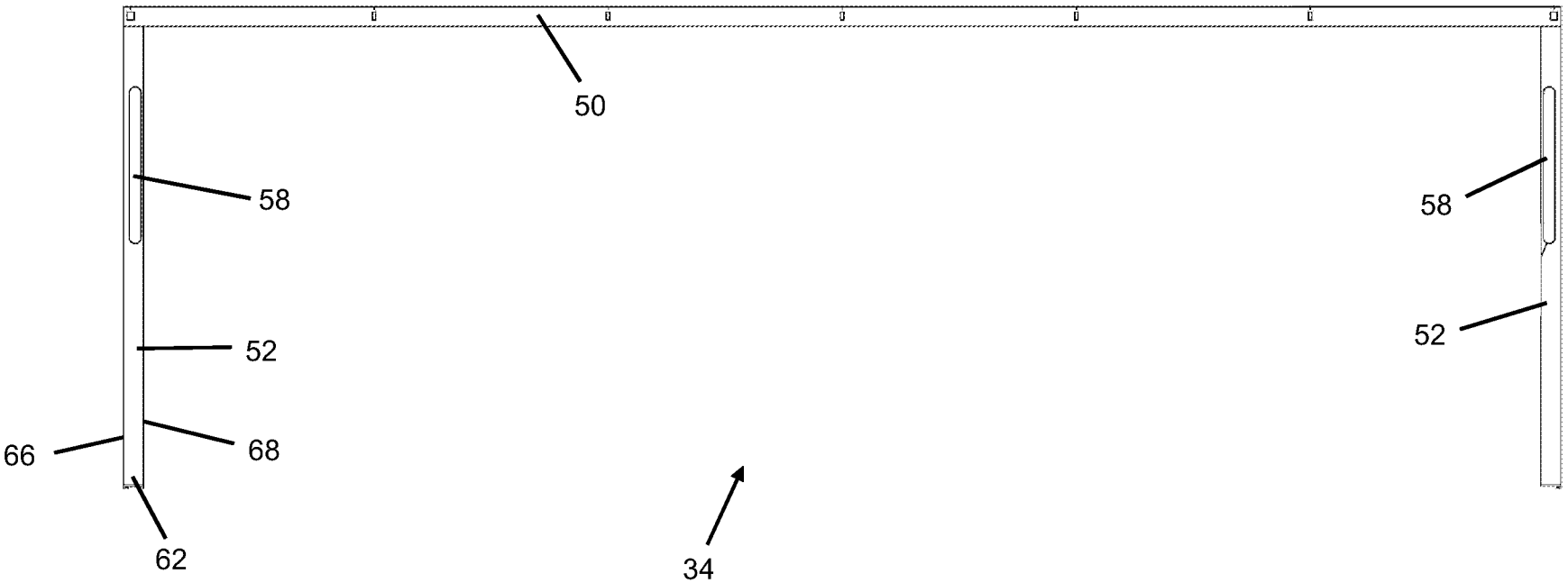
FIG. 6 is an elevation view of a door frame for the overhead door system.

The door frame 34, which is illustrated in FIG. 6, generally includes a top frame member 50 and side frame members 52. The top frame member 50 and the side frame members 52 are secured to the structure (not shown) in which the overhead door system 30 is installed. In certain embodiments, the top frame member 50 is oriented generally perpendicular to the side frame members 52.

In certain embodiments, the side frame members 52 may have a generally square profile that includes a first side 62, a second side 64, a third side 66 and a fourth side 68. The first side 62 is oriented towards the door leaf 32. The second side 64, which is opposite the first side 62, is oriented away from the door leaf 32.

The third side 66 extends between the first side 62 and the second side 64 towards an interior of the door frame 34. The fourth side 68, which is opposite the third side 66, extends between the first side 62 and the second side 64 away from an interior of the door frame 34. An opening is defined inside of the first side 62, the second side 64, the third side 66 and the fourth side 66.

The first side 62 has a slot 58 formed therein. The slot 58 extends through the first side into the opening. The slot 58 may have a generally elongated shape that is vertically oriented. The slot 58 has a width that is greater than a width of the at least one hydraulic cylinder 60.

A person of skill in the art will appreciate that it is possible for the side frame member 52 to have an alternative configuration with less than four sides. For example, in an alternative configuration, the side frame member 52 may have only two sides using the concepts of the invention.

A person of skill in the art will appreciate that the techniques used to secure the door frame components to the structure may be selected based upon factors such as the material from which the structure is fabricated, examples of which include, wood, steel, brick and concrete.

The door leaf 32 is pivotally attached to at least one of the top frame member 50 and the side frame members 52 such as using a hinge 56, which is illustrated in FIG. 7. Depending on the width of the door leaf 32, there may be at least one central upper hinge. Alternatively, the door leaf 32 may be pivotally attached to the side members 52, 54.

At least one hydraulic cylinder 60 operably connects the door leaf 32 to the door frame 34 and thereby facilitates a person moving the door leaf 32 between the closed configuration (FIGS. 1 and 2) and the open configuration (FIGS. 3 and 4) because the at least one hydraulic cylinder 60 reduces the amount of weight that the person needs to lift.

In certain embodiments, one of the hydraulic cylinders 60 is attached to each end of the door leaf 32. A person of skill in the art will appreciate that alternative structures may be used instead of hydraulic cylinders. An example of one such alternative structure is an electric actuator.

An upper end 70 of the hydraulic cylinder 60 may be mounted to the third side 66 in the interior of the side frame member 52. A reinforcing plate 72 may be used where the upper end 70 of the hydraulic cylinder 60 is attached to the third side 66 to minimize the potential of the side frame member 52 deforming during the operation of the overhead door system 30.

A lower end 74 of the hydraulic cylinder 60 may attached to a side surface of the door leaf 32 as illustrated in FIG. 7. A reinforcing plate 76 may be used where the lower end 74 of the hydraulic cylinder 60 is attached to side of the door leaf 32 to minimize the potential of the door leaf 32 deforming during the operation of the overhead door system 30.

The slot 58 is sufficiently large so that the hydraulic cylinder 60 does not contact any part of the side frame member 52 when the door leaf 32 is in the closed configuration, the open configuration or when moving between the closed configuration and the open configuration.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. An overhead door system comprising:

a frame having a first slot formed therein;

at least one hinge;

a door leaf having substantially planar front and back surfaces and further having a second slot formed between said front and back surfaces, wherein the door leaf is pivotally mounted to the frame with the at least one hinge so that the door leaf is vertically pivotable with respect to the frame; and a first hydraulic cylinder comprising a first cylinder end and a second cylinder end, wherein the first cylinder end is operably attached to the frame, wherein the second cylinder end is operably attached to the door leaf, wherein the first hydraulic cylinder is capable of moving the door leaf between a closed configuration and an open configuration and wherein when the door leaf is in the closed configuration, the first hydraulic cylinder is substantially recessed in the first slot and the second slot.

2. The overhead door system of claim 1, wherein the first slot has a width, wherein the first hydraulic cylinder has a width and wherein the first slot width is wider than the first hydraulic cylinder width.

3. The overhead door system of claim 1, wherein the frame comprises a top frame member, a first side frame member and a second side frame member and wherein the top frame member extends between the first side frame member and the second side frame member.

4. The overhead door system of claim 3, wherein the first side frame member comprises a first side, a second side, a third side and a fourth side, wherein the third side extends between the first side and the second side, wherein the fourth side extends between the first side and the second side, wherein an opening is defined inside of the first side, the second side, the third side and the fourth side and wherein the first slot extends through the first side into the opening.

5. The overhead door system of claim 1, wherein the door leaf comprises an upper frame member, a lower frame member, a first side frame member and a second side frame member, wherein the upper frame member extends between the first side frame member and the second side frame member, wherein the lower frame member extends between the first side frame member and the second side frame member, wherein the first slot is formed in the first side frame member and wherein the first hydraulic cylinder is mounted for movement with respect to the first slot.

6. The overhead door system of claim 5, wherein the first side frame member comprises a first side, a second side, a third side and a fourth side, wherein the third side extends between the first side and the second side and wherein the fourth side extends between the first side and the second side, wherein an opening is defined inside of the first side, the second side, the third side and the fourth side and wherein the first slot extends through the first side into the opening.

7. The overhead door system of claim 5, wherein a third slot is formed in the second side frame member and wherein the overhead door system further comprises a second hydraulic cylinder that is mounted for movement with respect to the third slot.

* * * * *